US010945313B2

(12) United States Patent
Rathi et al.

(10) Patent No.: US 10,945,313 B2
(45) Date of Patent: Mar. 9, 2021

(54) METHODS AND APPARATUS FOR A MICROWAVE BATCH CURING PROCESS

(71) Applicant: APPLIED MATERIALS, INC., Santa Clara, CA (US)

(72) Inventors: Saket Rathi, Rajasthan (IN); Ananthkrishna Jupudi, Singapore (SG); Mukund Sundararajan, Bangalore (IN); Manjunath Handenahalli Venkataswamappa, Bangalore (IN)

(73) Assignee: APPLIED MATERIALS, INC., Santa Clara, CA (US)

( * ) Notice: Subject to any disclaimer, the term of this patent is extended or adjusted under 35 U.S.C. 154(b) by 149 days.

(21) Appl. No.: 15/165,377

(22) Filed: May 26, 2016

(65) Prior Publication Data

US 2016/0353522 A1 Dec. 1, 2016

Related U.S. Application Data

(60) Provisional application No. 62/167,246, filed on May 27, 2015.

(51) Int. Cl.
*H05B 1/02* (2006.01)
*H05B 6/80* (2006.01)
(Continued)

(52) U.S. Cl.
CPC ..... *H05B 6/80* (2013.01); *F27B 5/04* (2013.01); *F27B 5/14* (2013.01); *H05B 6/6402* (2013.01); *H05B 6/645* (2013.01); *H05B 6/6447* (2013.01)

(58) Field of Classification Search
CPC ..... F27B 5/06; F27B 5/08; F27B 5/14; F27B 5/04; B08B 7/0007; H05B 6/6447; H05B 6/80; H05B 6/6402; H05B 6/645
See application file for complete search history.

(56) References Cited

U.S. PATENT DOCUMENTS 4,631,380 A * 12/1986 Tran ..... A22C 11/006 219/697
5,202,008 A * 4/1993 Talieh ..... B08B 7/0007 204/192.32

(Continued)

FOREIGN PATENT DOCUMENTS

JP 2014/007343 A 1/2014

OTHER PUBLICATIONS

International Search Report and Written Opinion dated Aug. 16, 2016 for PCT Application No. PCT/US2016/034489.

*Primary Examiner* — Steven S Anderson, II
(74) *Attorney, Agent, or Firm* — Moser Taboada

(57) ABSTRACT

In some embodiments, a process chamber for a microwave batch curing process includes: an annular body having an outer surface and an inner surface defining a central opening of the annular body, wherein the inner surface comprises a plurality of angled surfaces defining a first volume; a first lip extending radially outward from the outer surface of the annular body proximate a first end of the annular body; a second lip extending radially outward from the outer surface of the annular body proximate a second end of the annular body; an exhaust disposed between the first lip and the second lip and fluidly coupled to the first volume, wherein the exhaust comprises a plurality of first openings; a plurality of second openings fluidly coupled to the first volume, wherein the plurality of second openings are configured to expose the first volume to microwave energy; and one or more ports fluidly coupled to the first volume.

20 Claims, 11 Drawing Sheets

(51) Int. Cl.

| | |
|---|---|
| ***H05B 6/64*** | (2006.01) |
| ***F27B 5/04*** | (2006.01) |
| ***F27B 5/14*** | (2006.01) |

(56) References Cited

U.S. PATENT DOCUMENTS

| | | | | | |
|---|---|---|---|---|---|
| 5,324,485 | A * | 6/1994 | White | G21F 9/08 | 219/690 |
| 5,391,275 | A * | 2/1995 | Mintz | B08B 7/0007 | 134/1 |
| 5,538,699 | A * | 7/1996 | Suzuki | H01J 37/32192 | 118/723 MW |
| 5,698,036 | A * | 12/1997 | Ishii | C23C 16/511 | 118/723 MP |
| 2001/0055740 | A1* | 12/2001 | Bloom | B23K 1/008 | 432/247 |
| 2002/0100990 | A1* | 8/2002 | Platt | A61F 2/1627 | 264/1.38 |
| 2005/0051520 | A1 | 3/2005 | Tanaka | | |
| 2006/0102287 | A1* | 5/2006 | Grant | H01L 21/67103 | 156/345.51 |
| 2007/0102286 | A1* | 5/2007 | Scheible | C23C 14/3407 | 204/298.01 |
| 2009/0184399 | A1* | 7/2009 | Kowalski | H01L 21/324 | 257/618 |
| 2010/0184267 | A1* | 7/2010 | Kabe | H01L 21/02238 | 438/400 |
| 2012/0068603 | A1* | 3/2012 | Itoh | H01J 37/32192 | 315/111.41 |

* cited by examiner

METHODS AND APPARATUS FOR A MICROWAVE BATCH CURING PROCESS

CROSS-REFERENCE TO RELATED APPLICATIONS

This application claims benefit of U.S. provisional patent application Ser. No. 62/167,246, filed May 27, 2015, which is herein incorporated by reference in its entirety.

FIELD

Embodiments of the present disclosure generally relate to microwave batch curing processes.

BACKGROUND

Curing refers to toughening or hardening of polymer material by cross-linking of polymer chains. Conventional curing is done by furnace curing which takes place at a higher temperature as compared to microwave curing. Conventional curing typically takes more than 6 hours at greater than 220 degrees Celsius. However, the inventors have observed that a microwave curing process can be done under 1 hour and at less than 200 degrees Celsius. While furnace curing is slower as compared to microwave curing, due to the sheer volume of semiconductor wafers a conventional curing chamber can handle, the throughput of a conventional curing chamber outnumbers the faster microwave curing process. Therefore the inventors believe that there is a need to have a microwave compatible batch chamber that can match throughput of conventional curing without compromising curing uniformity within the batch.

Accordingly, the inventors have developed improved methods and apparatus for a microwave batch curing process.

SUMMARY

Methods and apparatus for a microwave batch curing process are provided herein. In some embodiments, an process chamber for a microwave batch curing process includes: an annular body having an outer surface and an inner surface defining a central opening of the annular body, wherein the inner surface comprises a plurality of angled surfaces defining a first volume; a first lip extending radially outward from the outer surface of the annular body proximate a first end of the annular body; a second lip extending radially outward from the outer surface of the annular body proximate a second end of the annular body; an exhaust disposed between the first lip and the second lip and fluidly coupled to the first volume, wherein the exhaust comprises a plurality of first openings; a plurality of second openings fluidly coupled to the first volume, wherein the plurality of second openings are configured to expose the first volume to microwave energy; and one or more ports fluidly coupled to the first volume.

In some embodiments, a process chamber for a microwave batch curing process includes: a plurality of annular bodies in a stacked configuration, wherein each annular body includes: an outer surface and an inner surface defining a central opening of the annular body, wherein the inner surface comprises a plurality of angled surfaces, and wherein the pluralities of angled surfaces of the plurality of annular bodies together define a first volume; a first lip extending radially outward from the outer surface of the annular body proximate a first end of the annular body; a second lip extending radially outward from the outer surface of the annular body proximate a second end of the annular body; an exhaust disposed between the first lip and the second lip and fluidly coupled to the first volume, wherein the exhaust comprises a plurality of first openings; a plurality of second openings fluidly coupled to the first volume, wherein the plurality of second openings are configured to expose the first volume to microwave energy; and one or more ports fluidly coupled to the first volume. The process chamber further includes a lid disposed atop a topmost annular body to seal an upper portion of the first volume; and a substrate transfer apparatus disposed beneath and coupled to a bottommost annular body for transferring a plurality of substrates into and out of the first volume.

In some embodiments, a method of performing a microwave batch curing process includes: providing a plurality of substrates to a process chamber comprising: an annular body having an outer surface and an inner surface defining a central opening of the annular body, wherein the inner surface comprises a plurality of angled surfaces defining a first volume; a first lip extending radially outward from the outer surface of the annular body proximate a first end of the annular body; a second lip extending radially outward from the outer surface of the annular body proximate a second end of the annular body; an exhaust disposed between the first lip and the second lip and fluidly coupled to the first volume, wherein the exhaust comprises a plurality of first openings; a plurality of second openings fluidly coupled to the first volume, wherein the plurality of second openings are configured to expose the first volume to microwave energy; and one or more ports fluidly coupled to the first volume; forming a vacuum within the apparatus; and exposing the plurality of substrates within the apparatus to microwaves.

Other and further embodiments of the present disclosure are described below.

BRIEF DESCRIPTION OF THE DRAWINGS

Embodiments of the present disclosure, briefly summarized above and discussed in greater detail below, can be understood by reference to the illustrative embodiments of the disclosure depicted in the appended drawings. However, the appended drawings illustrate only typical embodiments of the disclosure and are therefore not to be considered limiting of scope, for the disclosure may admit to other equally effective embodiments.

Figure 1:
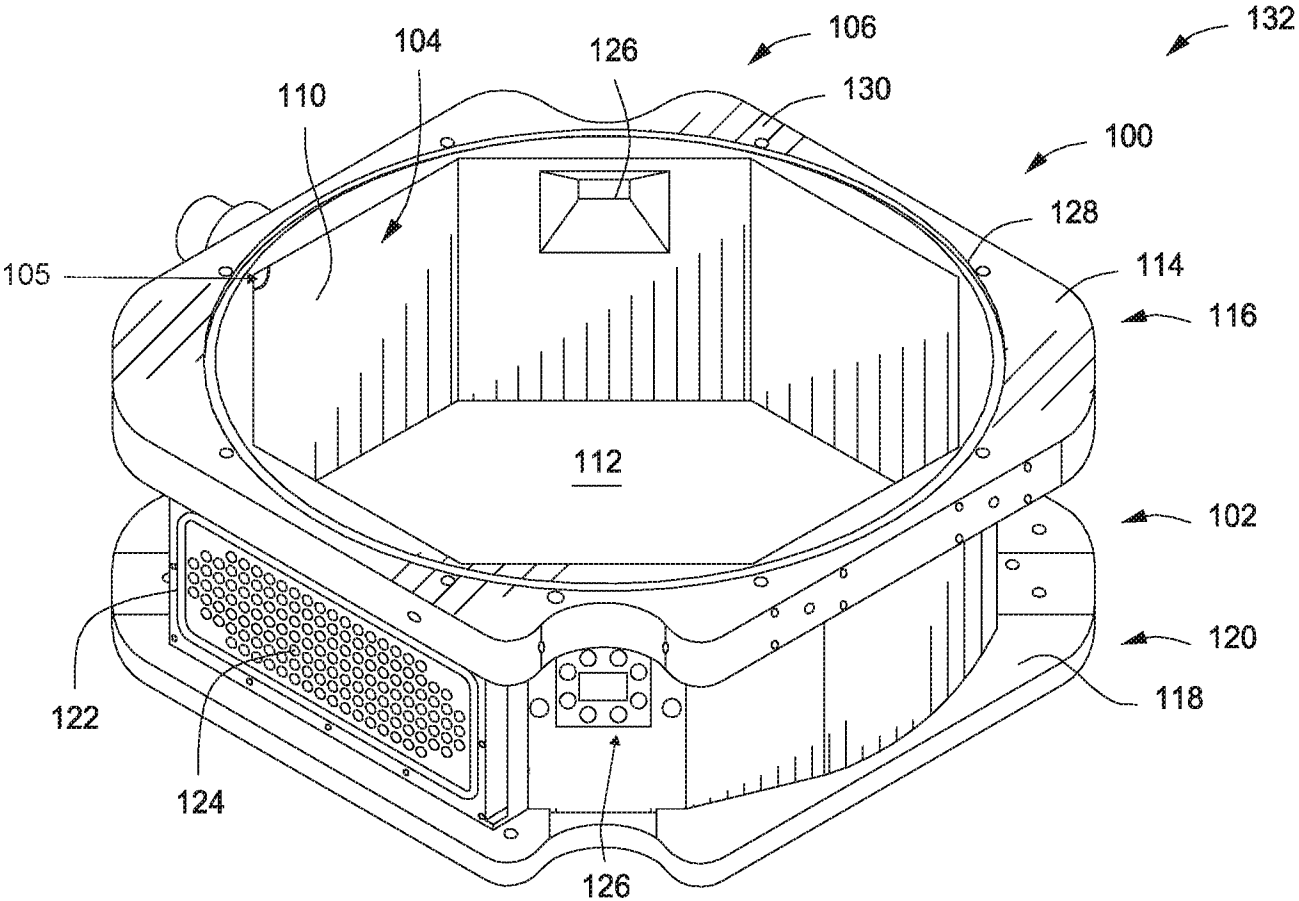
FIG. 1 depicts a schematic view of a process chamber for a microwave batch curing process in accordance with some embodiments of the present disclosure.

To facilitate understanding, identical reference numerals have been used, where possible, to designate identical elements that are common to the figures. The figures are not drawn to scale and may be simplified for clarity. Elements and features of one embodiment may be beneficially incorporated in other embodiments without further recitation.

DETAILED DESCRIPTION

Methods and apparatus for improved microwave batch curing processing are provided herein. The present disclosure provides an improved microwave batch curing process apparatus that may be utilized with a range of microwave frequencies for semiconductor manufacturing processes. Embodiments of the apparatus of the present disclosure may advantageously provide one or more of the following: spreading microwaves uniformly throughout the apparatus; minimizing or eliminating leakage of microwaves from the apparatus, attaining proper vacuum conditions, or minimizing or eliminate particle generation. In addition, embodiments of the apparatus of the present disclosure may be utilized in a configuration that advantageously provides flexibility in processing a variable number of substrates.

Figure 2:
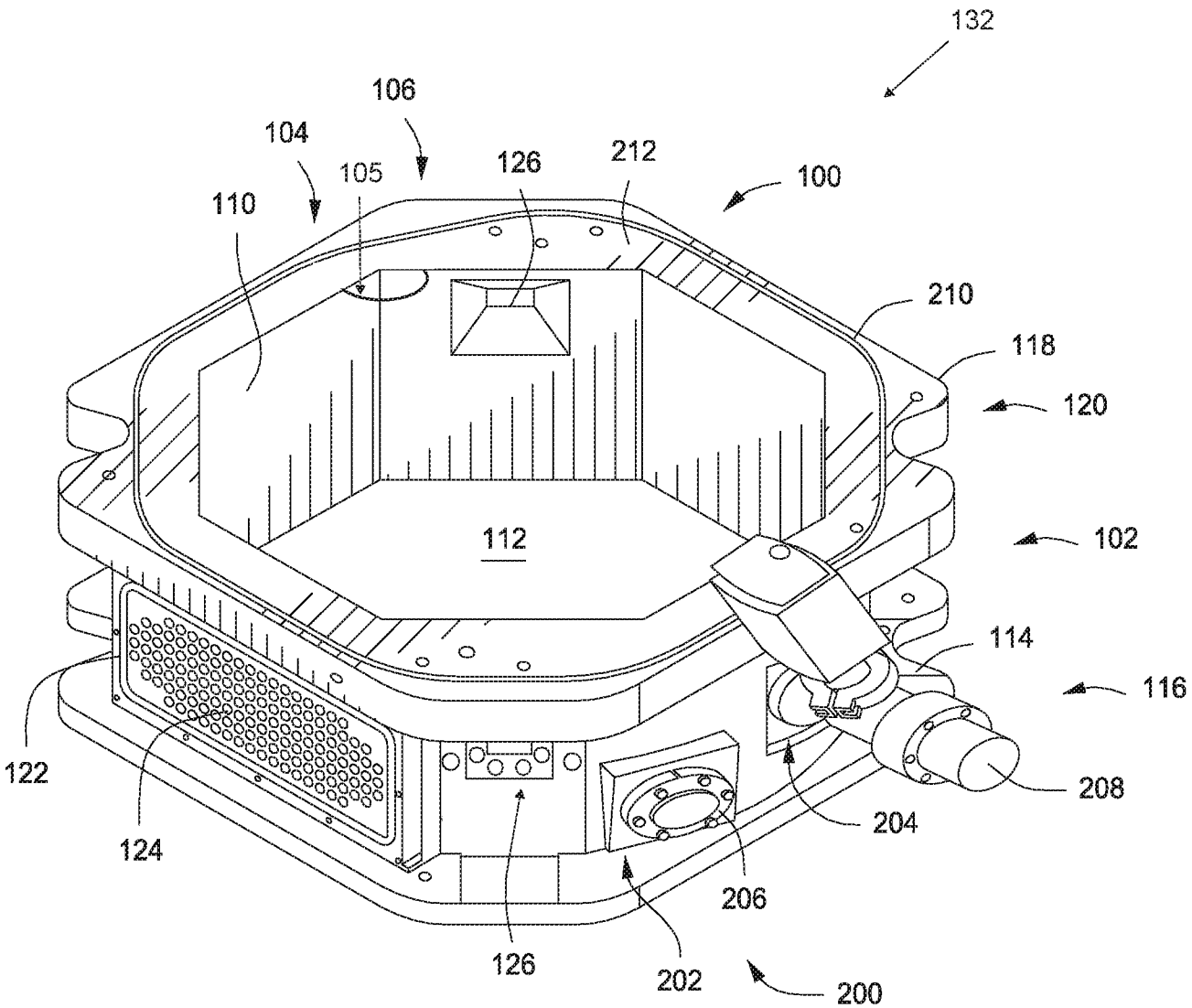
FIG. 2 depicts a schematic view of a process chamber for a microwave batch curing process in accordance with some embodiments of the present disclosure.

FIG. 1 and FIG. 2 depict schematic views of a process chamber 132 for a microwave batch curing process in accordance with some embodiments of the present disclosure. The process chamber 132 comprises an annular body 100. The annular body has a thickness sufficient for use as a microwave chamber as well as for assembly and use in batch processing substrates as disclosed herein. In some embodiments, the annular body 100 has a thickness of about 1 inch. In some embodiments, the annular body 100 has outer dimensions of about 22 inches by 22 inches by 8 inches, although other dimensions may be used, for example, when processing substrates having smaller or larger dimensions. In some embodiments, the annular body 100 is composed of aluminum.

Figure 9:
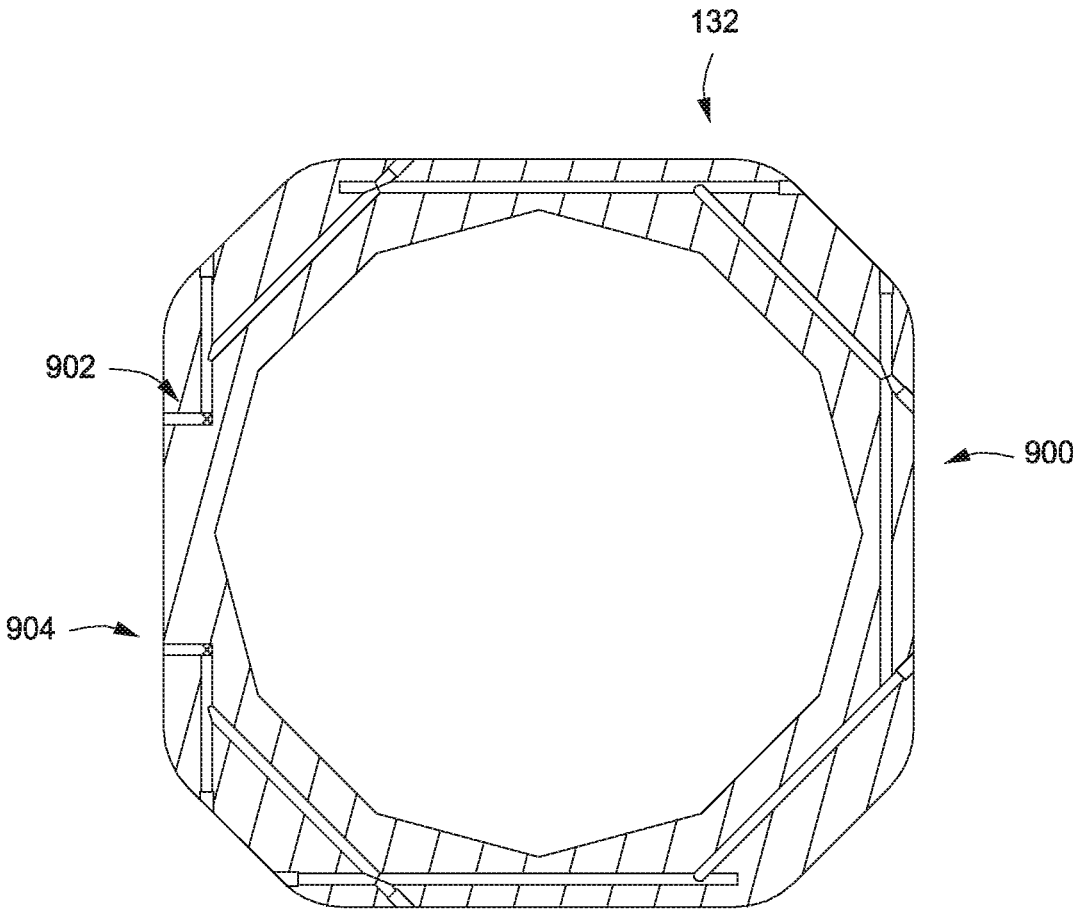
FIG. 9 depicts a cross-sectional view of a process chamber for a microwave batch curing process in accordance with some embodiments of the present disclosure.

In some embodiments, the process chamber includes one or more cooling channels to circulate a cooling fluid (e.g., a coolant) to control the temperature of the process chamber during use. For example, as depicted in FIG. 9, in some embodiments, the process chamber 132 comprises a plurality of channels 900 within the annular body 100 to circulate a cooling fluid. The plurality of channels 900 include an inlet 902 and an outlet 904 to facilitate circulating the cooling fluid (provided from a cooling fluid source) to prevent the outer surface of the annular body 100 from exceeding a predetermined temperature. In some embodiments, the predetermined temperature is about 65 degrees Celsius.

Figure 3:
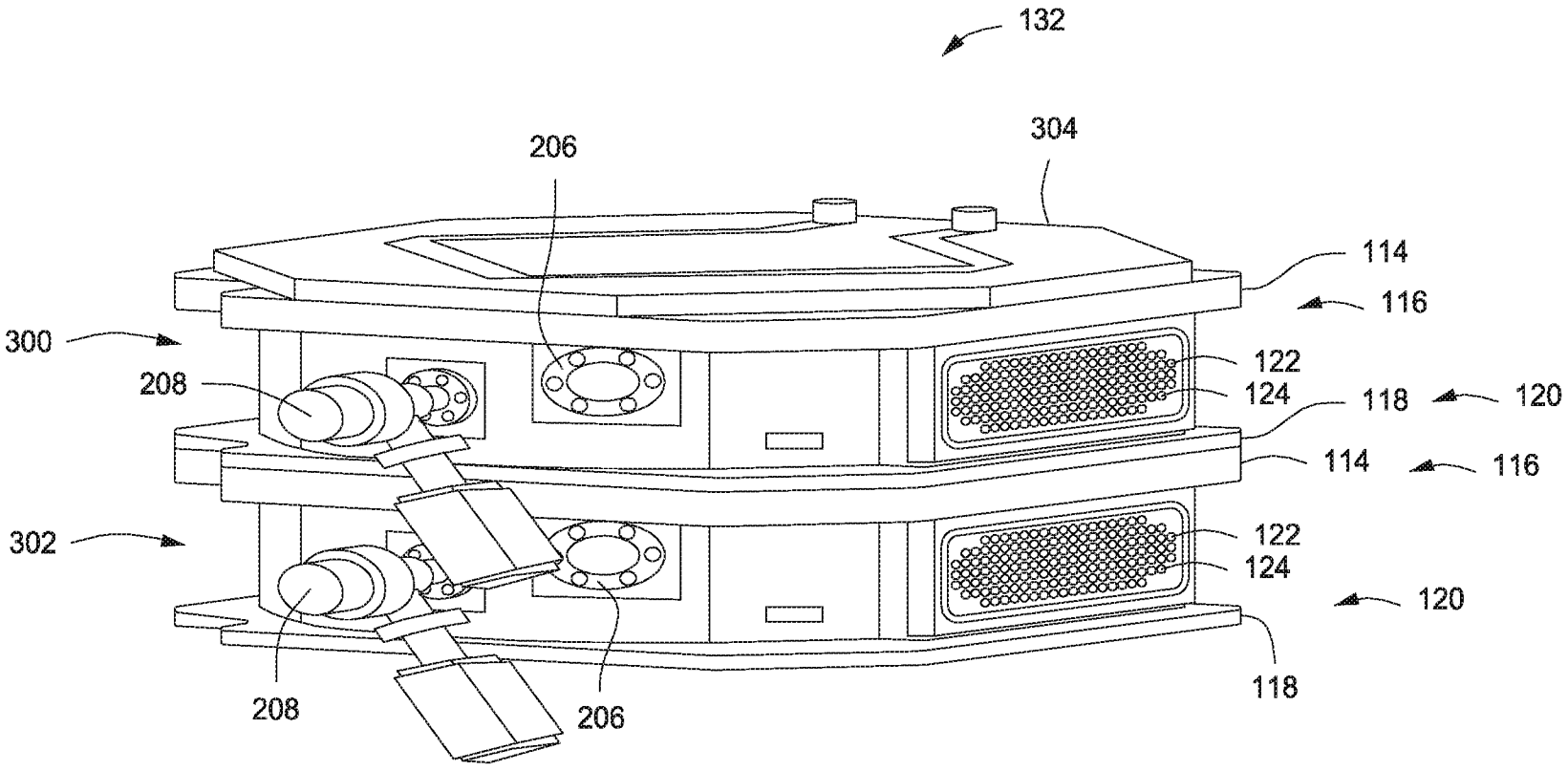
FIG. 3 depicts a schematic view of two process chambers for a microwave batch curing process in accordance with some embodiments of the present disclosure.

The annular body 100 comprises an outer surface 102 and an inner surface 104. The inner surface 104 defines a central opening 106 of the annular body 100. The inner surface 104 comprises a plurality of angled surfaces 110 defining a first volume 112. Each of the angled surfaces may be planar and parallel to a central axis of the annular body 100. Each of the angled surfaces may be arranged to have an equal included angle between each pair of adjacent angled surfaces One or more substrates, for example semiconductor wafers or other substrates having materials to be microwave cured may be disposed within the first volume 112 during curing operations. In some embodiments, the inner surface 104 has five (5) or more angled surfaces. In some embodiments, as depicted in FIGS. 1-3, the inner surface 104 has eight (8) angled surfaces. In some embodiments, for an inner surface 104 having 8 angled surfaces, the angle 105 between each angled surface 110 (i.e. between an angled surface 110 and an adjacent angled surface 110) is about 135 degrees. In some embodiments, for example FIG. 8, the inner surface 104 has twelve (12) angled surfaces. In some embodiments, for an inner surface 104 having 12 angled surfaces, the angle 105 between each angled surface 110 (i.e. between an angled surface 110 and an adjacent angled surface) is about 150 degrees. The inventors have observed that an inner surface 104 having a plurality of angled surfaces advantageously provides more uniform reflection and more uniform distribution of microwave energy, unlike a completely circular inner surface which will concentrate microwave energy at the center of the first volume 112. For example, the inventors have observed that a process chamber 132 having an inner surface 104 having, for example, 8 angled surfaces or 12 angled surfaces advantageously distributes microwaves uniformly throughout the first volume 112 to provide uniform curing of substrates within the first volume 112. Other numbers of angled surfaces may also be used, including more than 12 angled surfaces, although increasing numbers of angled surfaces may begin to approximate a circular inner surface.

The annular body 100 further comprises a first lip 114 (or first flange) and a second lip 118 (or second flange). The first lip 114 extends radially outward from the outer surface 102 of the annular body 100 proximate a first end 116 of the annular body 100. The second lip 118 extends radially outward from the outer surface 102 of the annular body 100 proximate a second end 120 of the annular body 100.

In some embodiments, the first lip 114 comprises a first groove 128 disposed within a first surface 130 of the first lip 114. In some embodiments, the first groove 128 is annular or substantially annular. In some embodiments, the first groove 128 has an opening with a width of about 0.27 inches. The first groove 128 is configured to retain a seal, such as an O-ring or similar gasket material, to form a seal when multiple process chambers 132 are in a stacked configuration, as described below with respect to FIG. 3. In some embodiments, as depicted in FIG. 2, the second lip 118 comprises a second groove 210 disposed within a first surface 212 of the second lip 118. In some embodiments, the second groove 210 is annular or substantially annular. In some embodiments, the second groove 210 has an opening with a width of about 0.094 inches. In some embodiments, the second groove 210 holds a conductive gasket to more robustly ground the process chambers 132 when multiple process chambers 132 are in a stacked configuration, as described below with respect to FIG. 3.

Figure 8:
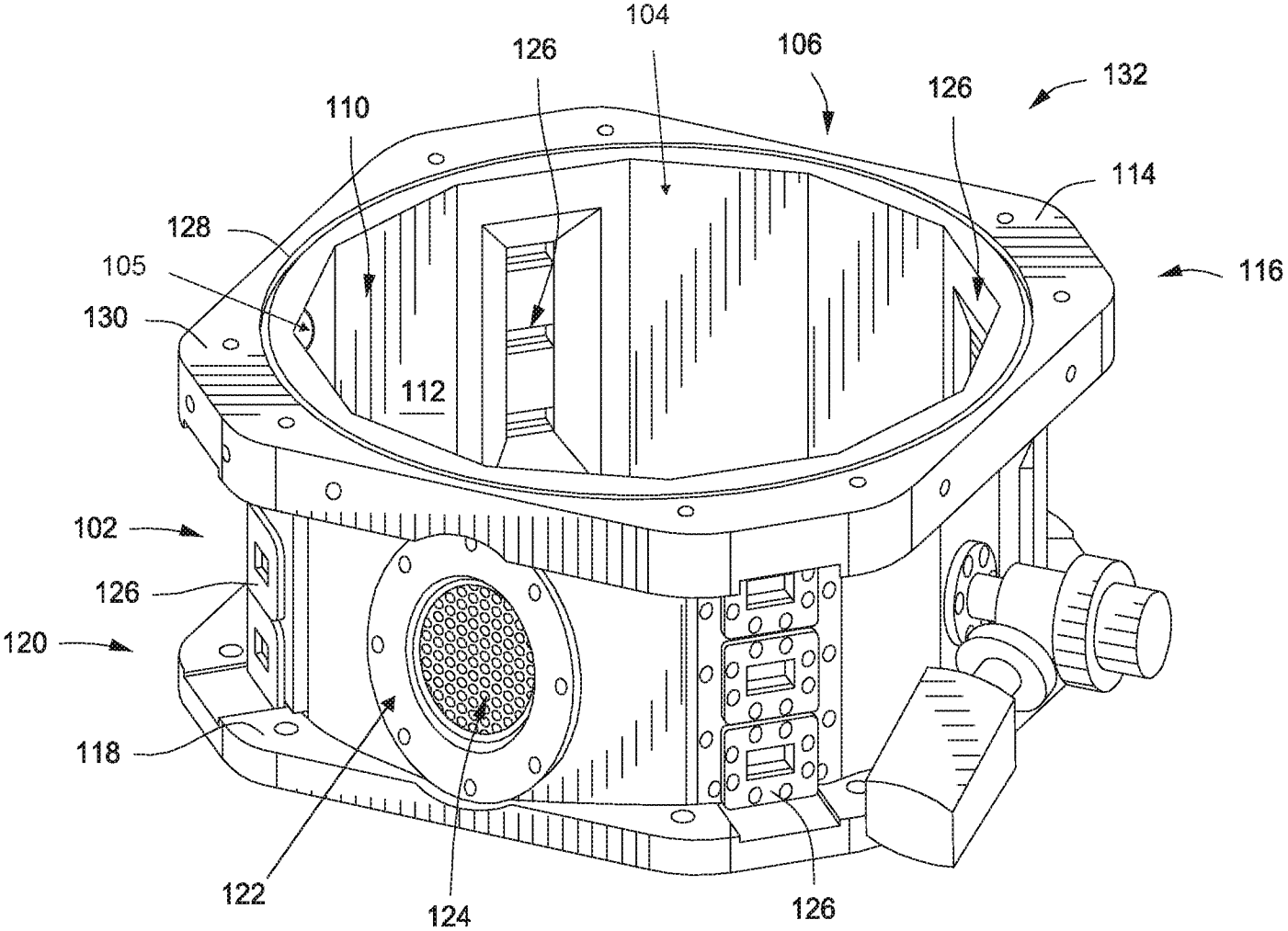
FIG. 8 depicts a schematic view of a process chamber for a microwave batch curing process in accordance with some embodiments of the present disclosure.

The annular body 100 further comprises an exhaust 122 disposed between the first lip 114 and the second lip 118. The exhaust 122 is fluidly coupled to the first volume 112. The exhaust 122 may generally have any shape and size to facilitate sufficient flow to maintain process parameters in the chamber, such as a desired pressure. In some embodiments, as depicted in FIGS. 1-3, the exhaust 122 may be rectangular, for example, having dimensions of about 11 inches by about 4 inches. In some embodiments, as depicted in FIG. 8, the exhaust 122 may be circular in shape. The exhaust 122 comprises a plurality of first openings 124 fluidly coupled to the first volume 112. In some embodiments, each of the plurality of first openings 124 comprises a diameter of less than about 10 mm.

The process chamber 132 is suitable for receiving variable frequency microwave energy having a frequency of less than about 6.9 GHz, for example about 4.5 GHz to about 6.9 GHz. In some embodiments, the process chamber 132 utilizes 4096 frequencies swept across the chamber in about 0.1 seconds over a frequency range of about 5.8 to about 6.9 GHz. The inventors have observed that any openings in the process chamber 132 that are greater than about one-half the wavelength of the microwave will undesirably leak out from openings in the process chamber 132. Thus, a diameter of less than about 10 mm for the plurality of first openings 124 advantageously exhausts gases from within the first volume 112 while preventing leakage of microwaves from the first volume 112. In some embodiments, the number of first openings 124 is chosen to match the conductance of the turbo pumps (not shown) coupled to the process chamber 132 for suction.

The annular body 100 further comprises a plurality of second openings 126 fluidly coupled to the first volume 112. The plurality of second openings 126 facilitate delivery of the microwave energy to the first volume 112. For example, each second opening 126 may be rectangular. In some embodiments, each second opening 126 may include angled sidewalls that enlarge the opening on a side of the opening facing the first volume 112. In some embodiments, the second openings 126 are disposed along the inner surface 104. In some embodiments, the second openings 126 are staggered, or spaced apart, along the inner surface 104. For example, in some embodiments as depicted in FIGS. 1 and 2, the annular body 100 comprises two second openings 126, wherein the two second openings 126 are disposed along the inner surface 104 opposite each other. For example, in some embodiments as depicted in FIG. 8, the annular body 100 comprises four second openings 126, wherein two of the four second openings 126 are disposed along the inner surface 104 opposite to each other and the other two second openings 126 are disposed along the inner surface 104 opposite to each other but not opposite to the first two second openings 126. For example, each of the second openings 126 may be equidistantly spaced about the annular body 100 (e.g., about 90 degrees apart in the embodiment depicted in FIG. 8). In some embodiments, for example as depicted in FIGS. 1 and 2, each second opening 126 is a singular opening at the inner surface 104. In some embodiments, for example as depicted in FIG. 8, each second opening 126 comprises multiple openings at the inner surface 104.

As depicted in FIG. 2, the annular body 100 comprises one or more ports 200 from the outer surface 102 through the inner surface 104 and fluidly coupled to the first volume 112. In some embodiments, the one or more ports 200 comprise a first port 202 and a second port 204 having a diameter of less than about 10 mm. As described above, having a diameter of less than about 10 mm prevents leakage of microwaves from the first volume 112 through the one or more ports 200.

Figure 5:
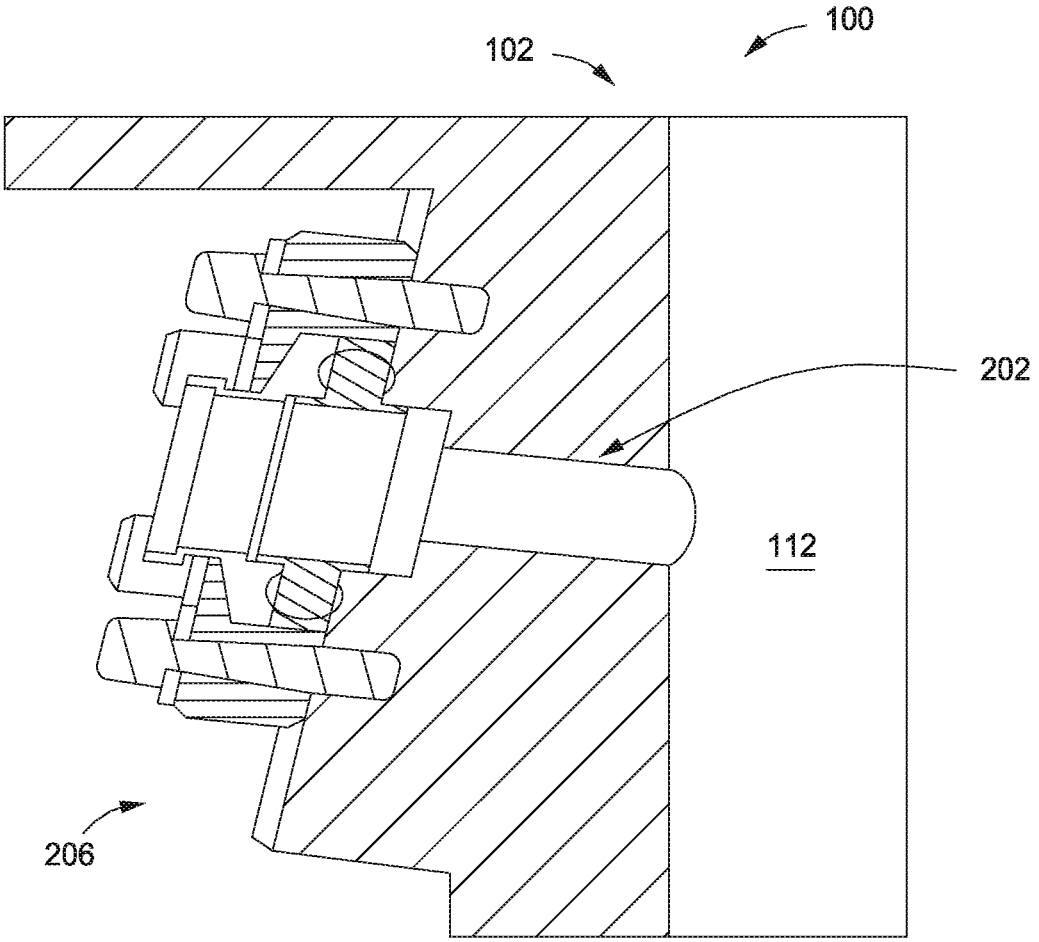
FIG. 5 depicts a schematic view of a temperature sensor coupled to a process chamber for a microwave batch curing process in accordance with some embodiments of the present disclosure.

In some embodiments, as depicted in FIG. 2, a temperature sensor 206 is disposed within the first port 202 to measure a temperature within the first volume 112. FIG. 5 depicts a schematic cross-sectional view of a temperature sensor 206 coupled to the annular body 100 via the first port 202.

Figure 4:
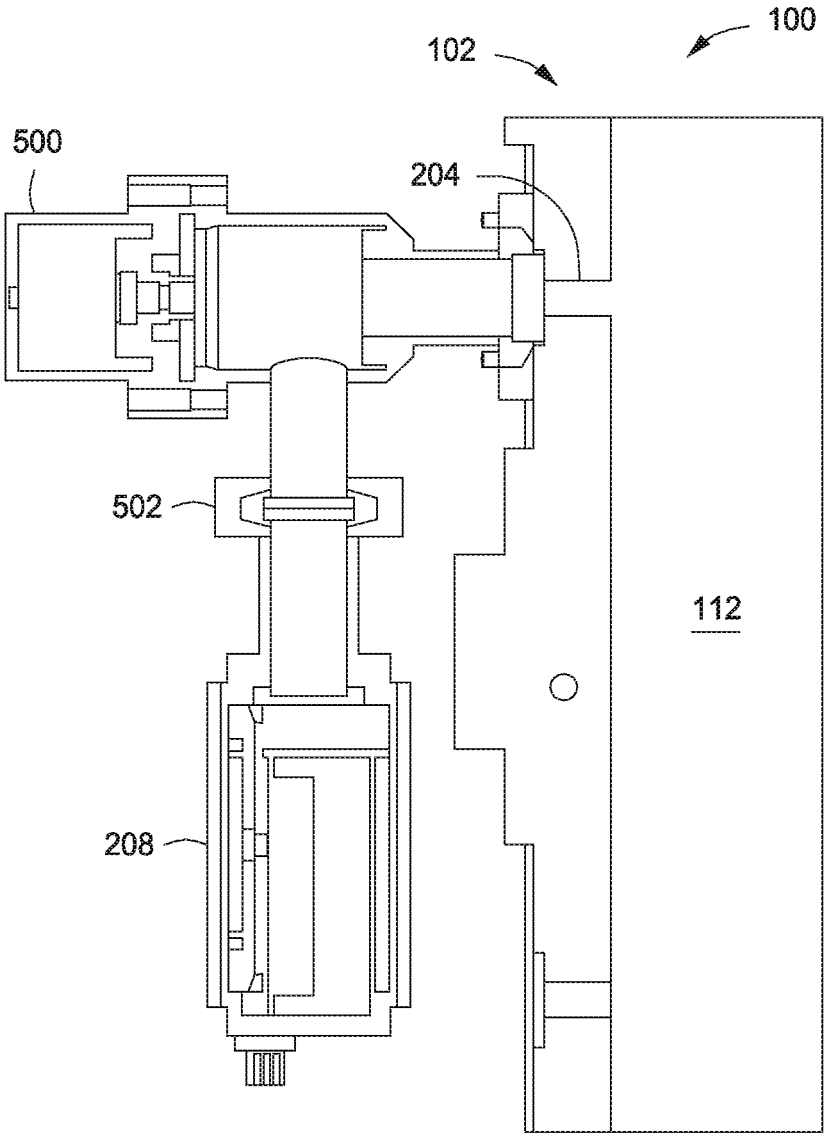
FIG. 4 depicts a schematic view of a pressure sensor coupled to a process chamber for a microwave batch curing process in accordance with some embodiments of the present disclosure.

In some embodiments, as depicted in FIG. 2, a pressure sensor 208 is coupled to the annular body 100 to measure the pressure within the first volume 112 via the second port 204. FIG. 4 depicts a schematic cross-sectional view of a pressure sensor 208 coupled to an isolation valve 500 via a clamp 502. The isolation valve 500 is coupled to the annular body 100 at the second port 204.

In some embodiments, as depicted in FIG. 3, a plurality of process chambers 132 may be coupled in a stacked configuration. For example, as depicted in FIG. 3, two process chambers 132 may be coupled in a stacked configuration. In some embodiments, as depicted in FIG. 3 the second lip 118 of the top body 300 is coupled to the first lip 114 of the bottom body 302. In some embodiments, the top body 300 is coupled to the bottom body 302 via suitable fasteners such as bolts or screws. In the stacked configuration as depicted in FIG. 3, the first volume 112 of the top body 300 is fluidly coupled to the first volume 112 of the bottom body 302. The first volume 112 of each body may hold, for example up to about 10 semiconductor wafers or other suitable substrates. The inventors have observed that the stackable configuration of the process chambers, as depicted in FIG. 3, advantageously provides the capability to handle batch wafers and provides the flexibility of choosing the number of wafers to be processed by increasing or decreasing the process chamber volume accordingly. The flexibility in process chamber volume allows for optimization of substrate cycle time depending upon substrate load. The top most process chamber in a stacked configuration, for example top body 300 in FIG. 3, includes a lid 304 to seal the first volume 112. The top most process chamber has a lid 304 disposed atop the process chamber to seal the first volume 112

Figure 6A:
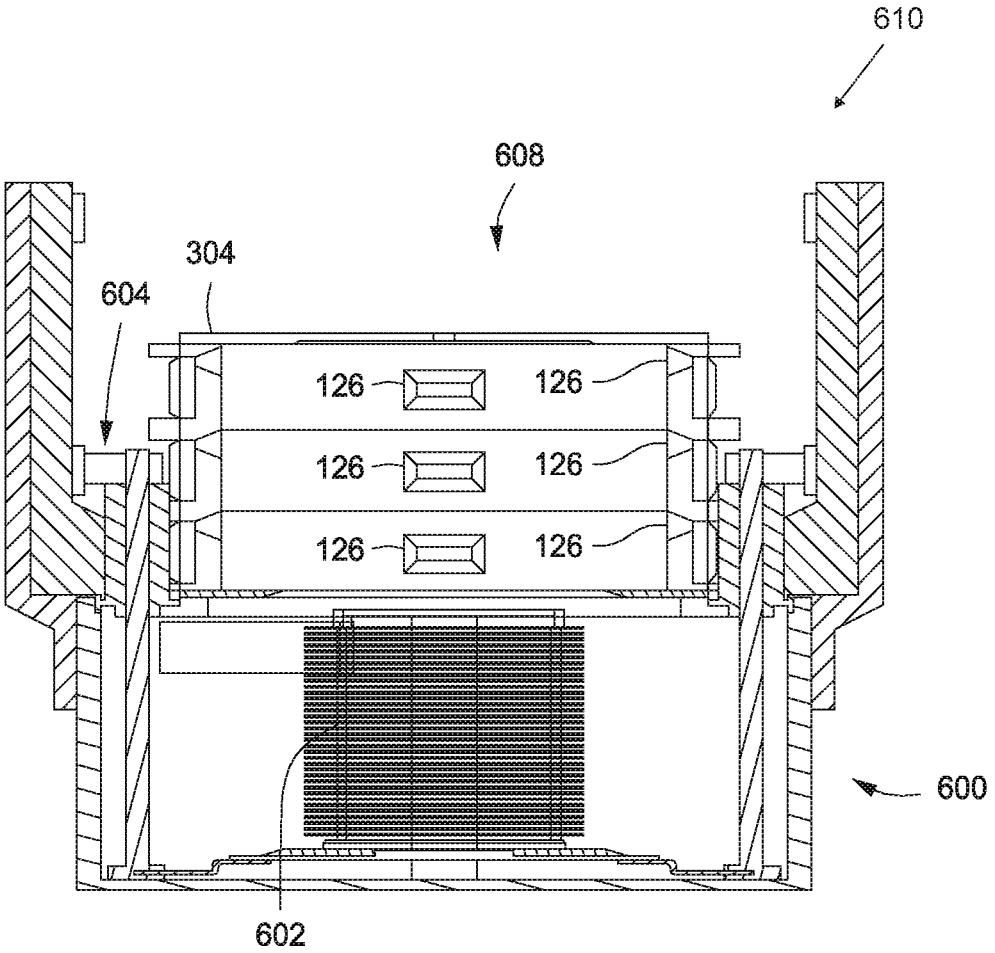
FIGS. 6A-6B respectively depict schematic side views of multiple process chambers for a microwave batch curing process in accordance with some embodiments of the present disclosure.
Figure 6B:
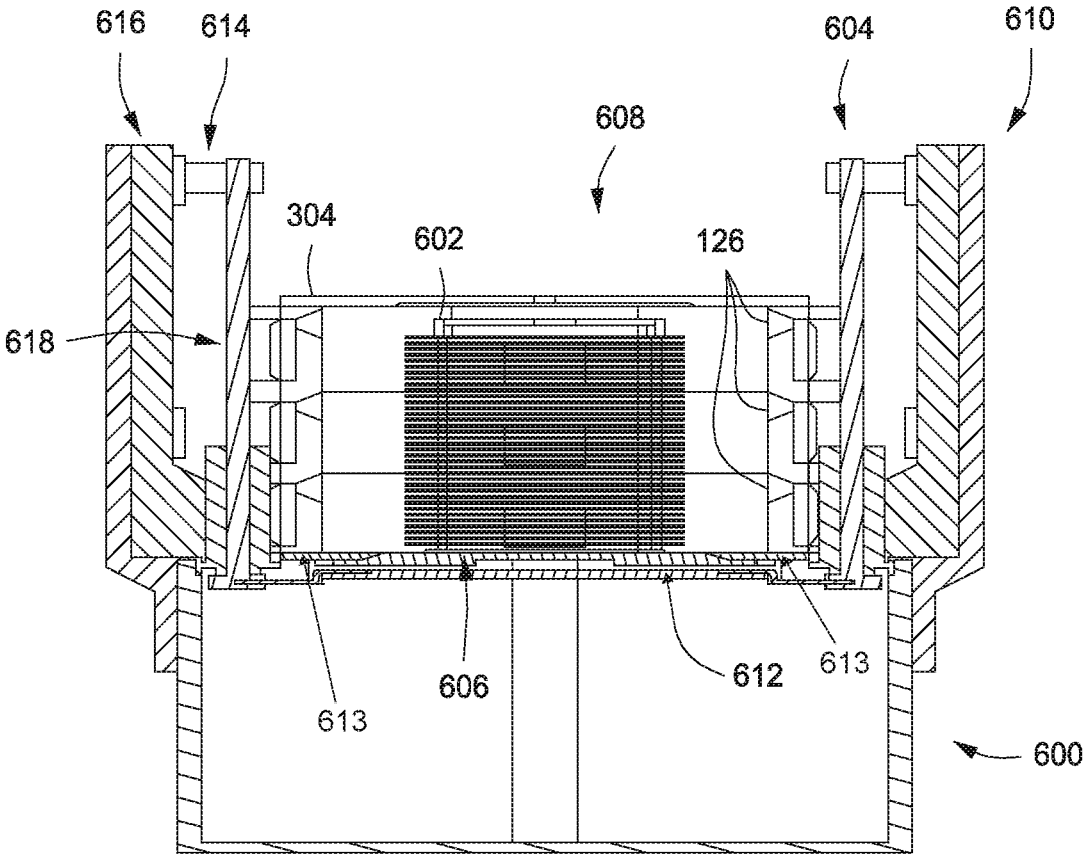

In some embodiments, one or more process chambers, as described above, may be stacked atop a substrate transfer apparatus 610 for transferring a plurality of substrates into and out of the process chambers. For example, FIGS. 6A and 6B depict a substrate transfer apparatus 610 having a lower chamber 600. As depicted in FIG. 6A, the lower chamber 600 holds a plurality of substrates 602. In some embodiments, the plurality of substrates 602 are aligned parallel to each other in a stacked configuration. One or more process chambers 608 as described above are disposed atop the lower chamber 600.

The top most process chamber of the one or more process chambers 608 has a lid 304 disposed atop the process chamber to seal the first volume 112 in the manner discussed above with respect to FIG. 3. While FIGS. 6A and 6B depict three process chambers 608 aligned in a stack above the lower chamber 600, as described above, more or less than three process chambers 608 may be utilized dependent upon the number of substrates to be processed.

Figure 11:
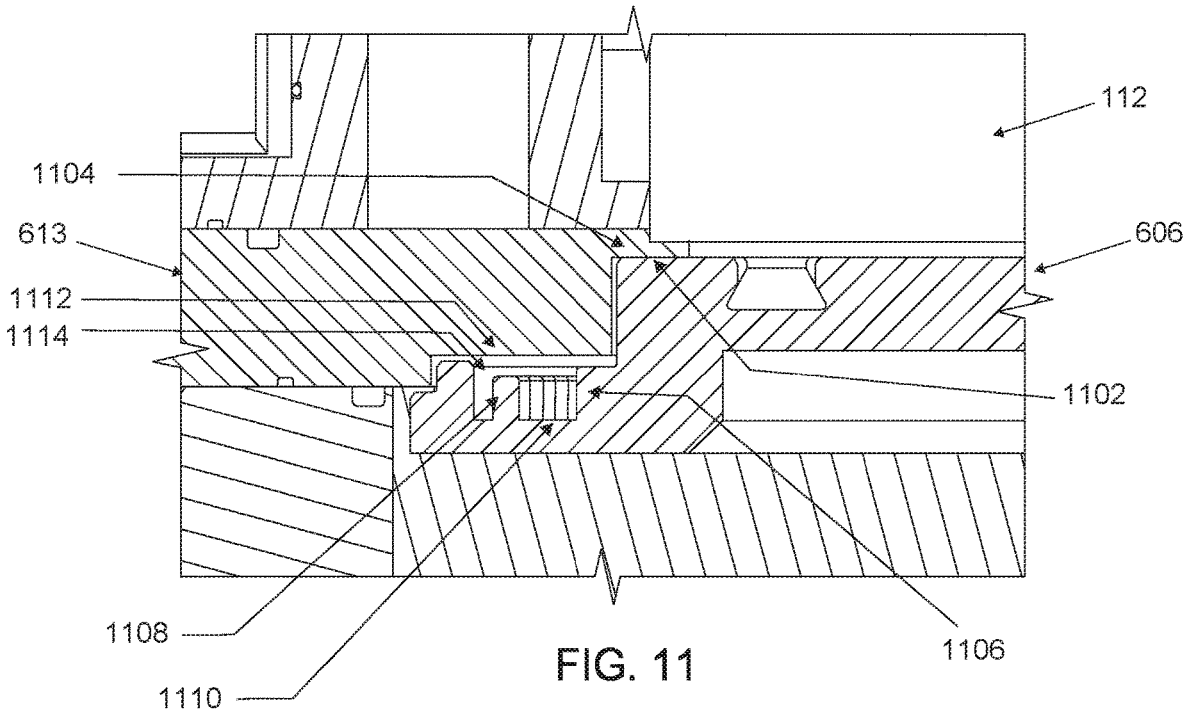
FIG. 11 depicts a cross-sectional view of a process chamber for a microwave batch curing process in accordance with some embodiments of the present disclosure.

As depicted in FIG. 6B, the plurality of substrates 602 can be positioned within the first volume 112 of the one or more process chambers 608. A lift mechanism 604 is provided to lift the plurality of substrates 602 from the lower chamber 600 into the first volume 112 of the one or more process chambers 608. The lift mechanism 604 may be any suitable lift mechanism, such as an actuator, motor, or the like. In some embodiments, the lift mechanism is coupled to a substrate support 612 that may be disposed in the lower chamber 600 or moved into the inner volume of the one or more process chambers 608. A plurality of moveable supports 614 are movably coupled to sidewalls 616 of the substrate transfer apparatus 610. A plurality of arms 618 have a first end coupled to the substrate support 612 and a second end coupled to the moveable supports 614. The moveable supports 614 move linearly along the sidewalls 616 of the substrate transfer apparatus 610 to raise or lower the substrate support 612 via the plurality of arms 618. Once the plurality of substrates 602 are raised into the first volume 112, a lower plate 606 coupled to the substrate support 612 seals a volume of the lower chamber 600 from the first volume 112 to prevent escape of microwaves and maintain a predetermined pressure in the first volume 112. The lower plate 606 butts up against, or mates with, an adapter 613 such that there is no gap, or a minimal gap, between the lower plate 606 and the adapter 613, thus sealing the first volume 112. The adapter 613 is coupled to an inner surface of the lower chamber 600. FIG. 11 depicts a schematic view of the lower plate 606 and the adapter 613 forming a seal to prevent escape of microwaves and maintain a predetermined pressure in the first volume 112. As depicted in FIG. 11, the lower plate 606 comprises a first portion 1102 that forms seal with a first portion 1104 of the adapter. The lower plate 606 further comprises an edge portion 1106 having an annular opening 1114, for example a groove or a trench, having a predetermined width. The annular opening 1114 comprises one or more protrusions 1108 extending away from a surface 1110 of the annular opening 1114 toward a surface 1112 of the adapter. In some embodiments, the multiple protrusions 1108 may be separated by a gap (not shown) of predetermined size. In some embodiments, the protrusions 1108 may extend perpendicular to the surface 1110 of the annular opening 1114. In some embodiments, the protrusions 1108 may extend at a predetermined angle to the surface 1110 of the annular opening 1114.

Figure 10:
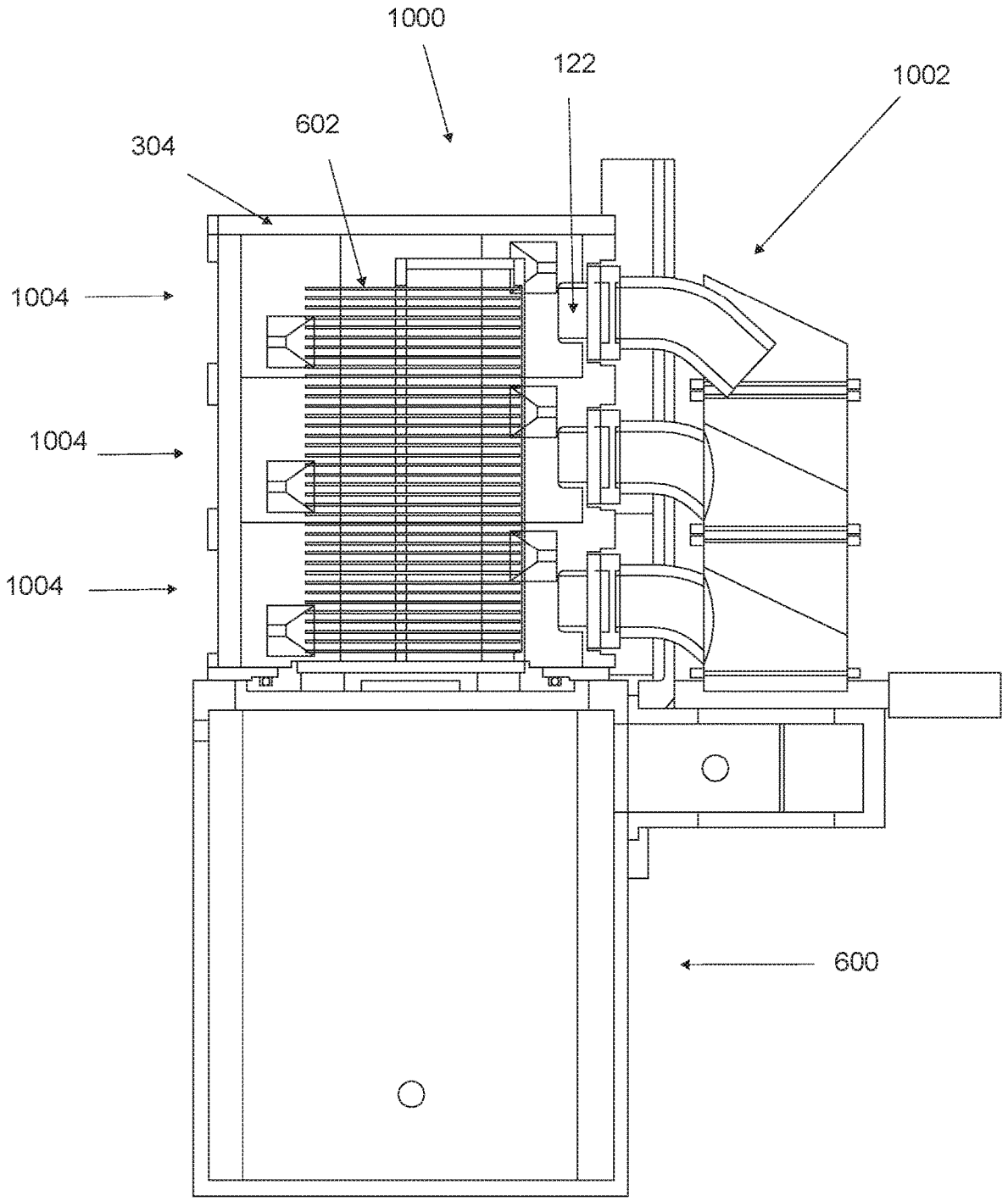
FIG. 10 depicts a schematic view of a multiple process chamber apparatus for a microwave batch curing process in accordance with some embodiments of the present disclosure.

FIG. 10 depicts a schematic view of a multiple process chamber apparatus 1000 for a microwave batch curing process in accordance with some embodiments of the present disclosure. FIG. 10 depicts one or more process chambers 1004 as described above, stacked atop a substrate transfer apparatus 610 for transferring a plurality of substrates into and out of the process chambers. The substrate transfer apparatus 610 comprises a lower chamber 600 to hold a plurality of substrates 602. As explained above with respect to FIG. 6B, the plurality of substrates 602 can be transferred from the lower chamber 600 to the first volume 112 of the one or more process chambers 1004. The top most process chamber 1004 of the one or more process chambers 1004 has a lid 304 disposed atop the process chamber 1004 to seal the first volume 112 in the manner discussed above with respect to FIG. 3. While FIG. 10 depicts three process chambers 1004 aligned in a stack above the lower chamber 600, as described above, more or less than three process chambers 1004 may be utilized dependent upon the number of substrates to be processed. FIG. 10 further depicts an exhaust system 1002 coupled to the exhaust 122 of each process chamber 1004.

Figure 7:
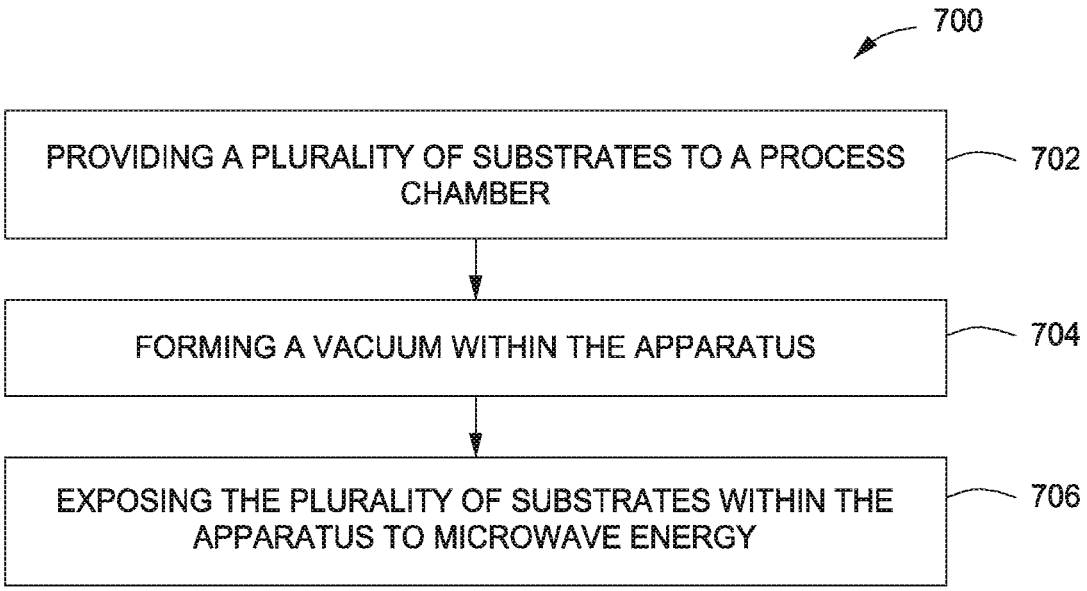
FIG. 7 depicts a flowchart of a method for performing a microwave batch curing process in accordance with some embodiments of the present disclosure.

FIG. 7 depicts a flowchart of a method 700 for performing a microwave batch curing process in accordance with some embodiments of the present disclosure. At 702, and as depicted in FIGS. 6A and 6B, a plurality of substrates 602 is provided to the first volume 112 of one or more process chambers 608 aligned in a stack and having the features described above. As depicted in FIGS. 6A-6B, the plurality of substrates 602 may be provided to the first volume 112 of the process chambers 608 from a lower chamber 600 via the lift mechanism 604. Next, at 704, a vacuum is formed within the first volume 112 by exhausting gases through the exhaust 122. Next, at 706, the plurality of substrates 602 within the first volume 112 is exposed to microwave energy for a suitable amount of time to undergo a microwave curing process. As described above, the angular surfaces of the inner surface 104 advantageously provides uniform reflection and uniform distribution of microwave energy to cure the plurality of substrates 602. Following the curing process, the plurality of substrates 602 are lowered from the first volume 112 into the lower chamber 600 and removed for further semiconductor manufacturing processes.

While the foregoing is directed to embodiments of the present disclosure, other and further embodiments of the disclosure may be devised without departing from the basic scope thereof.

The invention claimed is:

1. A process chamber for a microwave batch curing process, comprising:

an annular body comprising a first lip and a second lip, and the annular body having an outer surface and an inner surface defining a central opening of the annular body, wherein the inner surface comprises a plurality of angled surfaces defining a first volume, wherein the first lip extends radially outward from the outer surface of the annular body proximate a first end of the annular body, and wherein the second lip extends radially outward from the outer surface of the annular body proximate a second end of the annular body;

an exhaust disposed between the first lip and the second lip and fluidly coupled to the first volume, wherein the exhaust comprises a plurality of first openings; and a plurality of second openings fluidly coupled to the first volume and formed through the annular body, wherein the plurality of second openings are configured to expose the first volume to microwave energy, wherein the plurality of second openings comprises a pair of second openings that are diametrically opposed to each other and have a direct line of sight to each other, and wherein each second opening has a plurality of angled sidewalls such that each second opening increases in cross sectional area as the second opening extends from the outer surface to the inner surface.

2. The process chamber of claim 1, wherein the plurality of angled surfaces comprises 8 or 12 angled surfaces, wherein the 8 or 12 angled surfaces are parallel to a central axis of the annular body.

3. The process chamber of claim 1, wherein the plurality of second openings comprises a pair of second openings that are diametrically opposed to each other and have a direct line of sight to each other.

4. The process chamber of claim 1, wherein each one of the plurality of second openings has a rectangular cross sectional shape having a width that is greater than a height.

5. The process chamber of claim 1, wherein each second opening has four angled sidewalls.

6. The process chamber of claim 1, wherein each second opening comprises multiple openings at the inner surface.

7. The process chamber of claim 1, further comprising: one or more ports fluidly coupled to the first volume, wherein the one or more ports comprises a first port and a second port having a diameter of less than about 10 mm.

8. The process chamber of claim 7, further comprising at least one of a temperature sensor disposed within the first port or a pressure sensor disposed within the second port.

9. The process chamber of claim 1, further comprising a first annular groove disposed within a first surface of the first lip, wherein the first annular groove is configured to receive an o-ring.

10. The process chamber of claim 1, further comprising a second annular groove disposed within a first surface of the second lip, wherein the second annular groove is configured to receive an o-ring.

11. The process chamber of claim 1, further comprising a plurality of channels within the annular body configured to circulate a cooling fluid.

12. The process chamber of claim 1, further comprising:

a lid disposed atop the annular body to seal an upper portion of the first volume; and a substrate transfer apparatus coupled to a bottom of the annular body for transferring a plurality of substrates into and out of the first volume.

13. A process chamber for a microwave batch curing process, comprising:

a plurality of annular bodies in a stacked configuration, wherein each annular body comprises:

an outer surface and an inner surface defining a central opening of the annular body, wherein the inner surface comprises a plurality of angled surfaces, and wherein the pluralities of angled surfaces of the plurality of annular bodies together define a first volume;

a first lip extending radially outward from the outer surface of the annular body proximate a first end of the annular body;

a second lip extending radially outward from the outer surface of the annular body proximate a second end of the annular body;

an exhaust disposed between the first lip and the second lip and fluidly coupled to the first volume, wherein the exhaust comprises a plurality of first openings;

a plurality of second openings fluidly coupled to the first volume, wherein the plurality of second openings are configured to expose the first volume to microwave energy, wherein the plurality of second openings comprises a pair of second openings that are diametrically opposed to each other and have a direct line of sight to each other, and wherein each second opening has angled sidewalls such that each second opening increases in cross sectional area as the second opening extends from the outer surface to the inner surface wherein the plurality of second openings comprises a pair of second openings that are diametrically opposed to each other and have a direct line of sight to each other; and one or more ports fluidly coupled to the first volume;

a lid disposed atop a topmost annular body to seal an upper portion of the first volume; and a substrate transfer apparatus disposed beneath and coupled to a bottommost annular body for transferring a plurality of substrates into and out of the first volume.

14. The process chamber of claim 13, wherein the plurality of angled surfaces comprises 8 or 12 angled surfaces.

15. The process chamber of claim 13, further comprising:

a substrate support movable between an inner volume of the substrate transfer apparatus and the first volume, wherein the substrate support includes a lower plate; and an adapter coupled to the bottommost annular body, wherein the lower plate mates with the adapter to seal the first volume when the substrate support is moved into the inner volume to prevent escape of microwaves and maintain a predetermined pressure within the first volume.

16. The process chamber of claim 13, wherein each second opening comprises multiple openings at the inner surface.

17. The process chamber of claim 13, wherein the one or more ports comprises a first port and a second port having a diameter of less than about 10 mm.

18. The process chamber of claim 17, further comprising a temperature sensor disposed within the first port and a pressure sensor disposed within the second port.

19. A method of performing a microwave batch curing process, comprising:

inserting a plurality of substrates into a process chamber comprising an annular body having an outer surface and an inner surface defining a central opening of the annular body, wherein the inner surface comprises a plurality of angled surfaces defining a first volume; a first lip extending radially outward from the outer surface of the annular body proximate a first end of the annular body; a second lip extending radially outward from the outer surface of the annular body proximate a second end of the annular body; an exhaust disposed between the first lip and the second lip and fluidly coupled to the first volume, wherein the exhaust comprises a plurality of first openings; a plurality of second openings fluidly coupled to the first volume and formed through the annular body, wherein the plurality of second openings are configured to expose the first volume to microwave energy, wherein the plurality of second openings comprises a pair of second openings that are diametrically opposed to each other and have a direct line of sight to each other, and wherein each second opening has a plurality of angled sidewalls such that each second opening increases in cross sectional area as the second opening extends from the outer surface to the inner surface; and one or more ports fluidly coupled to the first volume;

forming a vacuum within the process chamber; and exposing the plurality of substrates within the process chamber to microwaves.

20. The method of claim 19, wherein the plurality of angled surfaces includes five or more angled surfaces.

* * * * *